US009614329B2

(12) United States Patent
Chen et al.

(10) Patent No.: US 9,614,329 B2
(45) Date of Patent: Apr. 4, 2017

(54) POWER PLUG, POWER RECEPTACLE AND POWER CONNECTOR ASSEMBLY

(71) Applicant: BELLWETHER ELECTRONIC CORP., Taoyuan (TW)

(72) Inventors: Kuan-Wu Chen, Taipei (TW); Hsing-Yu Lee, Taoyuan (TW)

(73) Assignee: BELLWETHER ELECTRONIC CORP, Taoyuan (TW)

( * ) Notice: Subject to any disclaimer, the term of this patent is extended or adjusted under 35 U.S.C. 154(b) by 0 days.

(21) Appl. No.: 15/140,198

(22) Filed: Apr. 27, 2016

(65) Prior Publication Data

US 2016/0240975 A1 Aug. 18, 2016

Related U.S. Application Data

(63) Continuation-in-part of application No. 14/444,484, filed on Jul. 28, 2014, now abandoned.

(30) Foreign Application Priority Data

Nov. 5, 2013 (TW) ..... 102220620 U

(51) Int. Cl.

| | |
|---|---|
| ***H01R 13/642*** | (2006.01) |
| ***H01R 13/627*** | (2006.01) |
| *H01R 105/00* | (2006.01) |
| *H01R 12/70* | (2011.01) |
| *H01R 12/71* | (2011.01) |

(52) U.S. Cl.
CPC ..... *H01R 13/642* (2013.01); *H01R 13/6272* (2013.01); *H01R 12/7088* (2013.01); *H01R 12/716* (2013.01); *H01R 2105/00* (2013.01)

(58) Field of Classification Search
USPC .. 439/678, 752, 345, 685, 78, 352, 594, 660
See application file for complete search history.

(56) References Cited

U.S. PATENT DOCUMENTS

D195,171 S * 5/1963 Keller ..... D13/146
4,368,939 A * 1/1983 Foederer ..... H01R 24/76 439/594
4,626,054 A * 12/1986 Tengler ..... H01R 13/516 439/594
D293,313 S * 12/1987 Justiano ..... D13/133
(Continued)

*Primary Examiner* — Alexander Gilman
(74) *Attorney, Agent, or Firm* — Li & Cai Intellectual Property (USA) Office

(57) ABSTRACT

A power plug including an insulation main body is provided. A first pillar and a second pillar arranged at the insulation main body. Only a first channel for inserting a first plug terminal is defined on the first pillar and multiple second channels for inserting second plug terminals are defined on the second pillar. A power receptacle including an insulation base is provided. A first slot and a second slot respectively corresponding to the first pillar and the second pillar are defined at the insulation base. Only a first receptacle terminal is inserted in the first slot. Multiple second receptacle terminals arranged at interval and parallel with each other are inserted in the second slot. The first receptacle terminal and the second receptacle terminals are arranged in a row. The power plug and the power receptacle are thereby limited to correctly couple.

15 Claims, 9 Drawing Sheets

(56) References Cited

U.S. PATENT DOCUMENTS

| | | | | | |
|---|---|---|---|---|---|
| 4,832,625 | A * | 5/1989 | Puerner | H01R 13/64 | 439/681 |
| 5,145,417 | A * | 9/1992 | Honkomp | H01R 13/68 | 439/502 |
| 5,387,110 | A * | 2/1995 | Kantner | H01R 29/00 | 403/316 |
| 5,533,915 | A * | 7/1996 | Deans | H01R 13/17 | 439/678 |
| 5,538,437 | A * | 7/1996 | Bates, III | H01R 13/6275 | 439/286 |
| D484,462 | S * | 12/2003 | Piovesan | D13/146 | |
| 8,545,275 | B2 * | 10/2013 | Wang | H01R 13/44 | 439/680 |
| 8,795,001 | B1 * | 8/2014 | Lam | H01R 12/7088 | 439/636 |
| 2004/0115996 | A1 * | 6/2004 | Carranza | H01R 23/27 | 439/752 |
| 2009/0047842 | A1 * | 2/2009 | Li | H01R 4/185 | 439/685 |
| 2011/0256748 | A1 * | 10/2011 | Davison | H01R 13/6273 | 439/345 |
| 2014/0302694 | A1 * | 10/2014 | Qiao | H01R 12/7023 | 439/78 |

* cited by examiner

POWER PLUG, POWER RECEPTACLE AND POWER CONNECTOR ASSEMBLY

CROSS REFERENCE TO RELATED APPLICATIONS

This application is a Continuation-in-Part of application Ser. No. 14/444,484, filed Jul. 28, 2014, now pending, and entitled POWER PLUG AND POWER RECEPTACLE.

BACKGROUND

The present disclosure is related to power connectors, particularly a power plug including anti-wrong means and a corresponding power receptacle.

DESCRIPTION OF RELATED ART

Since no anti-wrong means is provided for known power connectors, a male power connector can be plugged into a female power connector along a correct direction or a counter direction. Furthermore, the male power connector can also be plugged into the female power connector as the male power connector is deflected 90 degrees, and the connectors might therefore be broken. Software or hardware damages resulted from miss operation might occur if the connectors are not allowed to be coupled along the counter direction or other directions and no anti-wrong means is provided for the connectors.

In views of this, in order to solve the above disadvantage, the present inventor studied related technology and provided a reasonable and effective solution in the present disclosure.

SUMMARY

The present disclosure is providing a power plug including anti-wrong means and a corresponding power receptacle, the anti-wrong means can work in any incorrect plugging direction, and the thereby ensuring a correct connection to prevent from software or hardware damages.

In order to achieve above objectives, a power plug for coupling with a power receptacle includes an insulation main body, a first pillar and a second pillar. The insulation main body having a main body front surface, and the insulation main body is defined a transversal direction on the main body front surface. The first pillar is protruded from the main body front surface with a first uniform cross-sectional shape. The first pillar has a first front end surface, a first top surface, a first bottom surface parallel to the first top surface and two first side surfaces opposite to each other. The first pillar has a first channel formed therein along a longitudinal direction of the first pillar, and a first plug terminal arranged in the first channel. The second pillar is protruded from the main body front surface along the longitudinal direction with a second uniform cross-sectional shape, having a second front end surface, a second top surface, a second bottom surface parallel to the second top surface and two second side surfaces opposite to each other. The second pillar is arranged beside the first pillar along the transversal direction. An interval is formed between the first pillar and the second pillar. The second pillar has a plurality of second channels formed therein along the longitudinal direction, and a plurality of second plug terminals disposed in the second channels respectively. The first channel and the second channels are arranged in a row along the transversal direction. A number of the second plug terminals is larger than a number of the first plug terminal. The first front end surface of the first pillar and the second front end surface of the second pillar are coplanar. The first top surface of the first pillar and the second top surface of the second pillar are coplanar. The first bottom surface of the first pillar and the second bottom surface of the second pillar are coplanar. A width of the first pillar between the two first side surfaces is smaller than a width of the second pillar between the two second side surfaces.

In order to achieve above objectives, a power receptacle for coupling with above power plug is further provided in the present disclosure, and the power receptacle includes an insulation base, a first receptacle terminal and a plurality of second receptacle terminals. The insulation base has a base front surface, a first slot formed therein for receiving the first pillar and a second slot formed therein for receiving the second pillar. The first slot and the second slot are arranged at interval. The first slot and the second slot are arranged along a transversal direction of the base front surface. The first slot is encircled by a first inner top surface, a first inner bottom surface parallel to the first inner top surface, and two parallel first inner side surfaces. The second slot is encircled by a second inner top surface, a second inner bottom surface parallel to the second inner top surface, and two parallel second inner side surfaces. The first inner top surface and the second inner top surface are coplanar. The first inner bottom surface and the second inner bottom surface are coplanar. The first receptacle terminal is disposed in the first slot for coupling with the first plug terminal. A plurality of second receptacle terminals is disposed in the second slot for coupling with the second plug terminals respectively. The second plug terminals are arranged at interval and parallel with each other. The first receptacle terminal and the second receptacle terminals are arranged in a row along the transversal direction. A number of the first receptacle terminal is larger than a number of the second receptacle terminals.

In order to achieve above objectives, a power connector assembly is provided, and includes a power plug as above-mentioned, and a power receptacle as above-mentioned.

The second pillar of the power plug is not able to plug into the first slot of the power receptacle. By mixed arrangement of the first pillar and the second pillar, the power plug can plug into the power receptacle only along a correct coupling direction.

DETAILED DESCRIPTION OF EMBODIMENT

Figure 1:
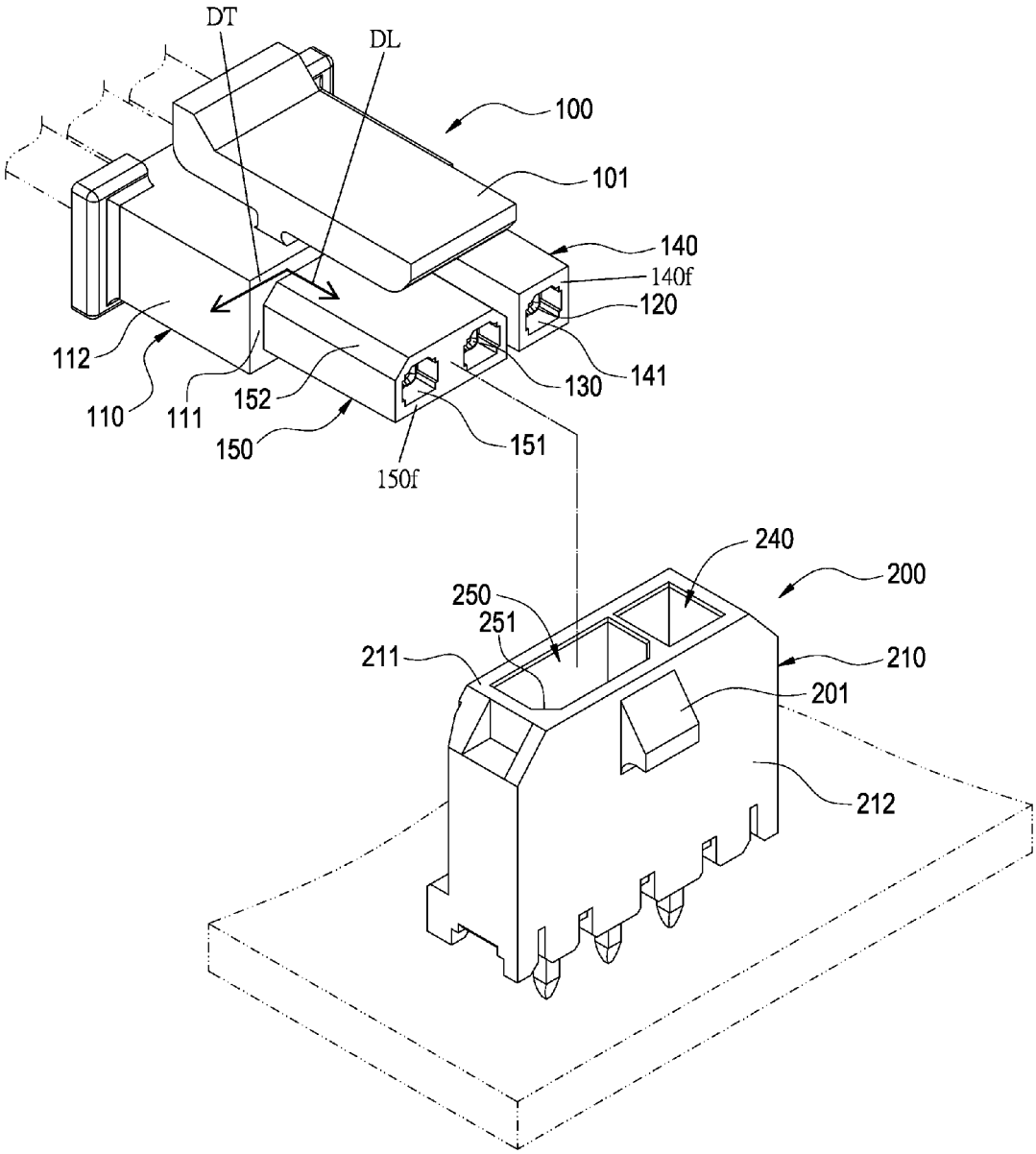
FIG. 1 is a schematic diagram showing the power plug and the power receptacle of the first embodiment of the present disclosure.

Please refer to FIGS. 1-4. A power plug 100 and a corresponding power receptacle 200 are provided in the first embodiment of the present disclosure. The power plug 100 can be plugged in the power receptacle 200 to become a power connector assembly. In the present embodiment, the power plug 100 is included of an insulation main body 110, a first plug terminal 120 and two second plug terminal 130. In this embodiment, a number of the second plug terminals 130 is more than a number of the first plug terminal 120.

Figure 2:
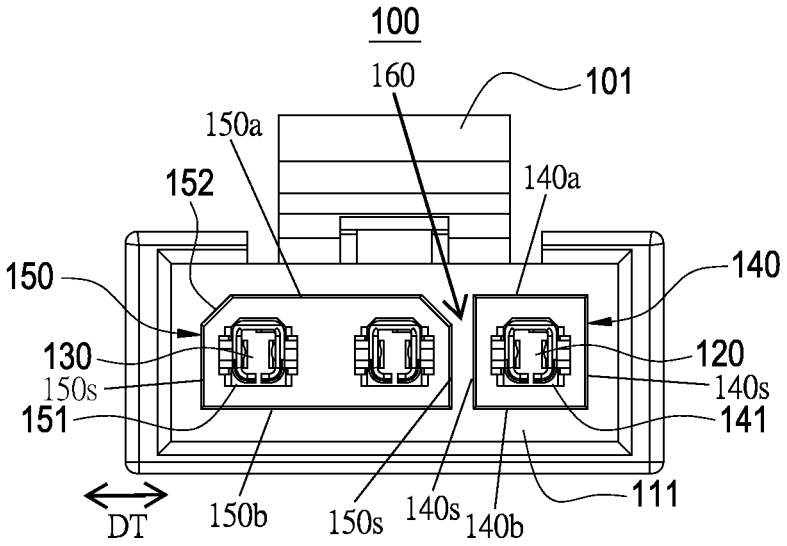
FIG. 2 is a schematic diagram showing the power plug of the first embodiment.
Figure 3:
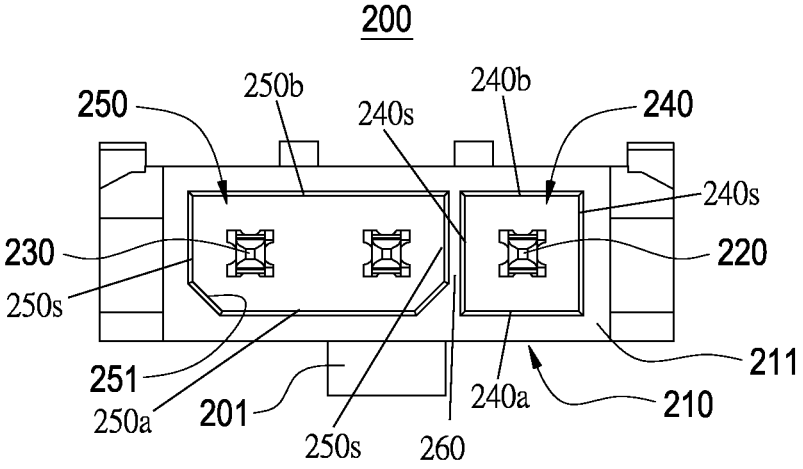
FIG. 3 is a schematic diagram showing the power receptacle of the first embodiment.

The insulation main body 110 is preferable a hexahedral and made of plastic. The insulation main body 110 has a main body front surface 111 and four main body lateral surfaces 112 surrounding the main body front surface 111, and each main body lateral surface 112 is preferably perpendicular connected with the main body front surface 111. The insulation main body 110 is defined with a transversal direction DT on the main body front surface 111. As shown in FIG. 1, a first pillar 140 is protruded from the main body front surface 111 along a longitudinal direction DL with a first uniform cross-sectional shape. In this embodiment, the first uniform cross-sectional shape is a rectangular columnar shape. A second pillar 150 is protruded from the main body front surface 111 along a longitudinal direction with a second uniform cross-sectional shape. In this embodiment, the second uniform cross-sectional shape is a substantial rectangular columnar shape with two external chamfers 152, which is describe in detail in following paragraphs. An interval 160 is formed between the first pillar 140 and the second pillar 150. Refer to FIG. 1 and FIG. 2. The first pillar 140 is of a rectangular columnar shape, and has a first front end surface 140*f*, a first top surface 140*a*, a first bottom surface 140*b* parallel to the first top surface 140*a* and two first side surfaces 140*s* opposite to each other. The first front end surface 140*f* is parallel to the main body front surface 111. A first channel 141 is formed in the first pillar 140 along a longitudinal direction of the first pillar 140.

A hook 101 is provided on one of the main body lateral surface 112, and the hook 101 is preferably extended over the main body front surface 111. Specifically, in this embodiment, the hook 101 is extended above the first top surface 140*a* of the first pillar 140 and the second top surface 150*a* of the second pillar 150.

As shown in FIG. 1 and FIG. 2. The second pillar 150 is of a rectangular columnar shape having a second front end surface 150*f*, a second top surface 150*a*, a second bottom surface 150*b* parallel to the second top surface 150*a* and two second side surfaces 150*s* opposite to each other. The second front end surface 150*f* is parallel to the main body front surface 111. The second pillar 150 is arranged beside the first pillar 150 along the transversal direction DT. At least a width of the second pillar 150 is larger than the maximum width of the first pillar 140. Namely, a width of the first pillar 140 between the two first side surfaces 140*s* is smaller than a width of the second pillar 150 between the two second side surfaces 150*s*. The first front end surface 140*f* of the first pillar 140 and the second front end surface 150*f* of the second pillar 150 are substantially coplanar. The first top surface 140*a* of the first pillar 140 and the second top surface 150*a* of the second pillar 150 are substantially coplanar. The first bottom surface 140*b* of the first pillar 140 and the second bottom surface 150*b* of the second pillar 150 are substantially coplanar.

The multiple second channels 151 are defined on the second pillar 150 along a longitudinal direction of the second pillar 150. In the present embodiment, the first channel 141 and the second channels 151 are arranged in a column matrix and parallel with each other.

The first plug terminal 120 is made of metal and preferably of a tubular shape. The first plug terminal 120 is inserted in the first channel 141. Each second plug terminal 130 is made of metal and preferably of a tubular shape. Each second plug terminal 130 is inserted in the corresponding second channel 151.

The power receptacle 200 is used for coupling with the power plug 100. The power receptacle 200 is included of an insulation base 210, a first receptacle terminal 220 and two second receptacle terminal 230. The insulation base 210 is preferable a hexahedral and made of plastic. The insulation base 210 has a base front surface 211 and four base lateral surfaces 212 surrounding the main body front surface 111, and each base lateral surface 212 is preferably perpendicular connected with the base front surface 211. A first slot 240 for coupling with the first pillar 140 and a second slot 250 for coupling with the second pillar 150 are defined on the base front surface 211, and a latch 201 for snapping the hook 101 is provided on one of the base lateral surface 212. The first slot 240 and the slot 250 are arranged at interval, and the first slot 240 and the slot 250 are arranged respectively corresponded to the first pillar 140 and the second pillar 140. A partition wall 260 is formed between the first slot 240 and the second slot 250. The partition wall 260 is received in the interval 160 of the power plug 100, when the power plug 100 is plugged in the power receptacle 200. Two second internal chamfers 251 are respectively formed at two corners in the second slot 250. The second internal chamfers 251 are fitted with the first external chamfers 152 correspondingly. In this embodiment, two first external chamfers 152 are formed on the second pillar 150, which are connected the second top surface 150*a* and the two second side surfaces 150*s* respectively.

The first receptacle terminal 220 is made of metal, the first receptacle terminal 220 is preferably of a pillar shape, and an outer contour of the first receptacle terminal 220 is corresponded to an inner contour of the first plug terminal 120. The first receptacle terminal 220 is inserted in the first slot 240 and used for coupling with the first plug terminal 120.

Each second receptacle terminal 230 is made of metal, and the second receptacle terminal 230 is preferably of a pillar shape and has the same structure as the first receptacle terminal 220. Each second receptacle terminal 230 is used for coupling with the corresponding second plug terminal 130, the second receptacle terminals 230 are respectively inserted in the corresponding second slot 250, and the second receptacle terminals 230 are arranged at interval in a row and parallel with each other. The first receptacle terminal 220 and the second receptacle terminal 230 are arranged in a row. Each first receptacle terminal 220 is extended through a bottom of the corresponding first slot 240, and each second receptacle terminal 230 is extended through a bottom of the corresponding second slot 250.

Figure 4:
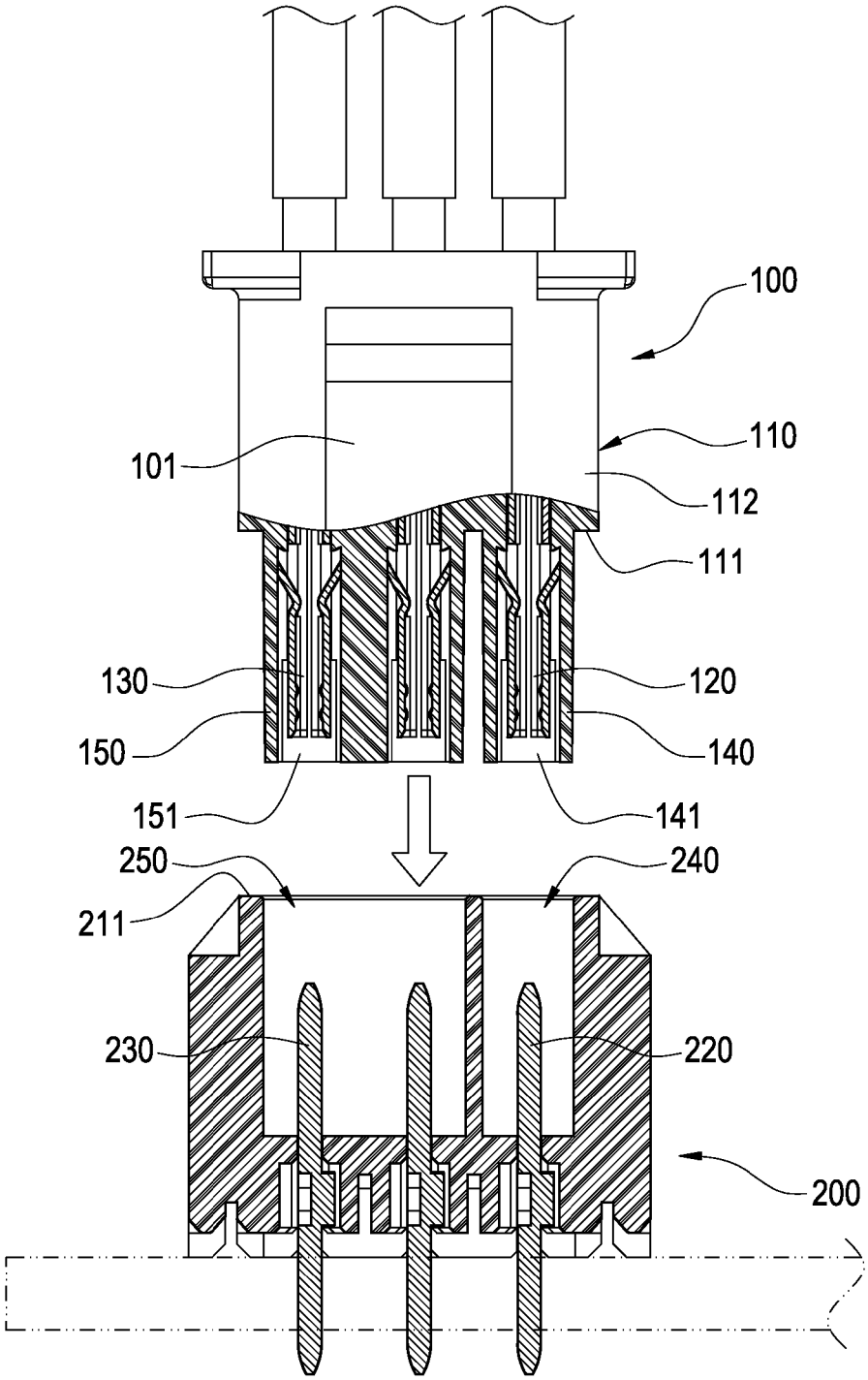
FIG. 4 is a schematic diagram showing the power plug coupled with the power receptacle.
Figure 5:
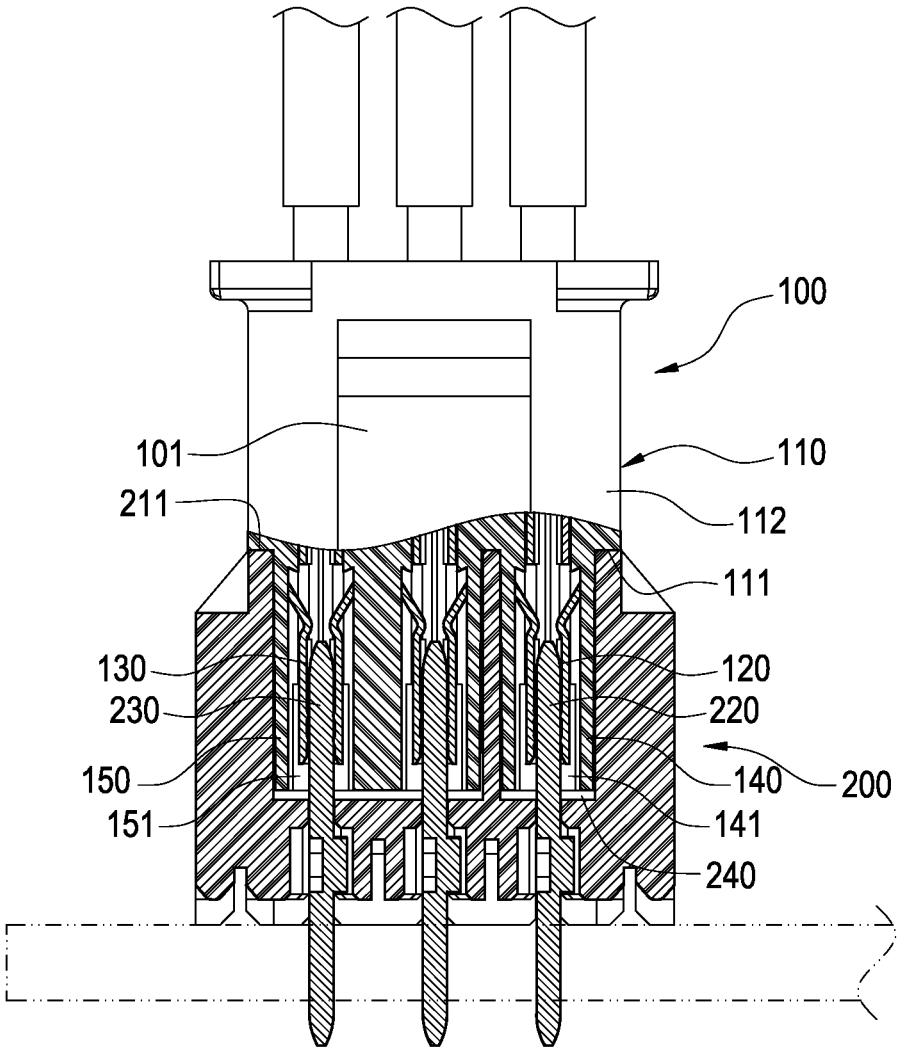
FIG. 5 is another schematic diagram showing the power plug coupled with the power receptacle.

Please refer to FIGS. 4 and 5. The first pillar 140 is inserted into the first slot 240 while the power plug 100 is correctly coupled with the power receptacle 200, and the first plug terminal 120 in the first pillar 140 is thereby electrically connected with the first receptacle terminal 220. The second pillar 150 is meanwhile inserted into the second slot 250, and each second plug terminal 130 in the second pillar 150 is thereby respectively electrically connected with the corresponding second receptacle terminal 230. The hook 101 of the power plug 100 is snap-locked with the latch 201 of the power receptacle 200, and the both are thereby firmly connected with each other.

Figure 6:
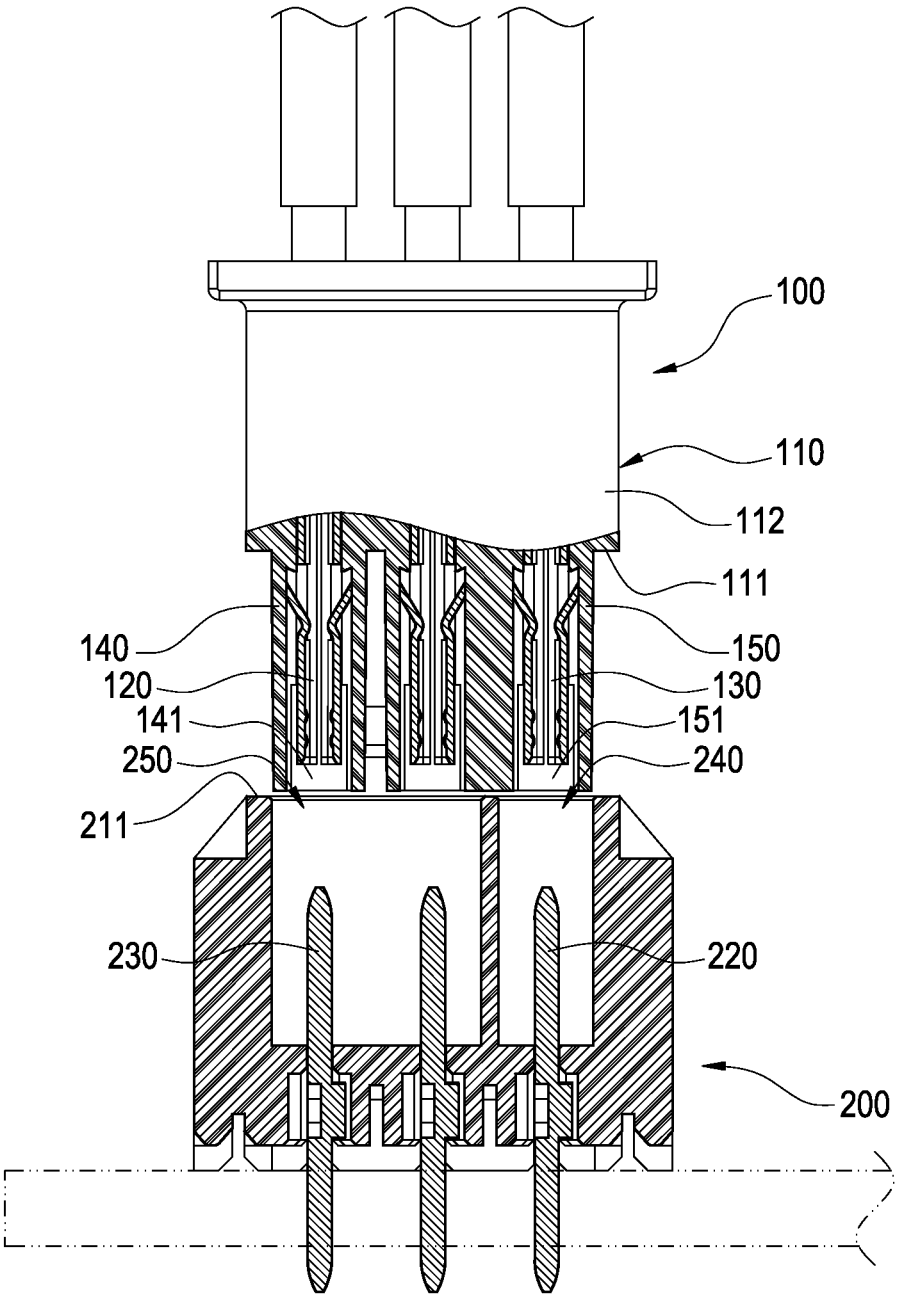
FIG. 6 is a schematic diagram showing the power plug incorrectly coupled with the power receptacle.

Please refer to FIG. 6. The second pillar 150 cannot be inserted into the first slot 240 while the power plug 100 is incorrectly coupled with the power receptacle 200. The power plug 100 and the power receptacle 200 are limited by the mixed arrangement of the first pillar 140 and the second pillar 150 and therefore able to be couple with each other merely along a correct direction.

Figure 7:
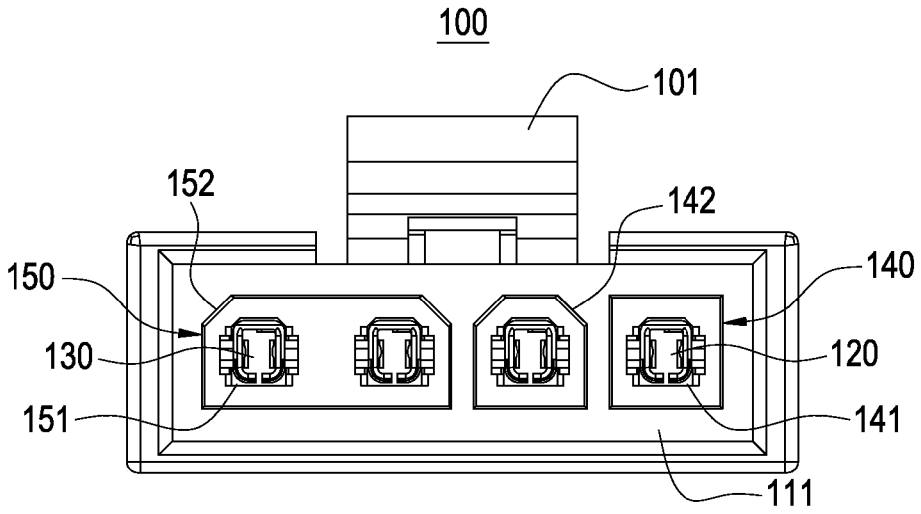
FIG. 7 is a schematic diagram showing the power plug of the second embodiment.
Figure 8:
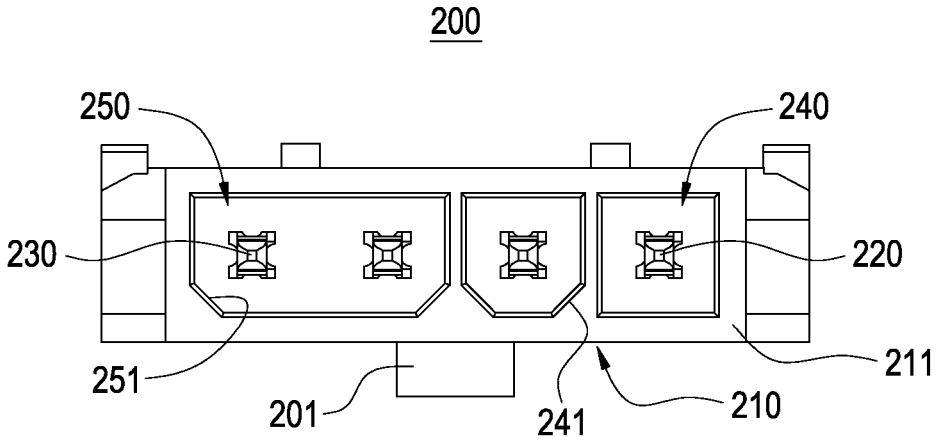
FIG. 8 is a schematic diagram showing the power receptacle of the second embodiment.

Please refer to FIGS. 7 and 8. A power plug 100 and a corresponding power receptacle 200 are provided in the second embodiment of the present disclosure. In the present embodiment, the power plug 100 and the power receptacle 200 are similar to those described in the first embodiment, therefore the descriptions for the same/similar elements are omitted here for brevity.

In the present embodiment, two first pillars 140 and a second pillar 150 are extended from the insulation main body 110 of the power plug 100, a first plug terminal 120 is contained in each first pillar 140, and two second channels 151 are defined on the second pillar 150 to contain two second plug terminals 130. The first plug terminals 120 and the second plug terminals 130 are arranged in a row. The power receptacle 200 has a structure corresponding to the power plug 100. Two first slots 240 and a second slot 250 are defined on the insulation base 210, a first receptacle terminal 220 is contained in each first slot 240, and two second receptacle terminals 230 are contained in the second slot 250.

Figure 9:
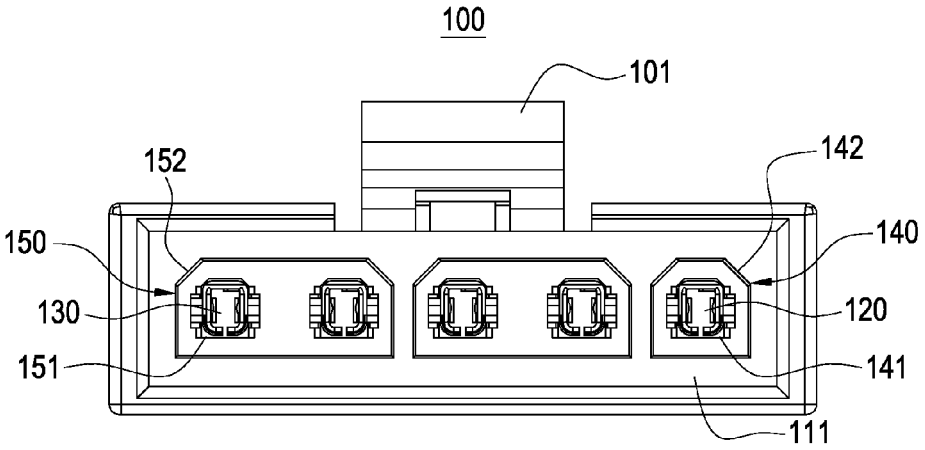
FIG. 9 is a schematic diagram showing the power plug of the third embodiment.
Figure 10:
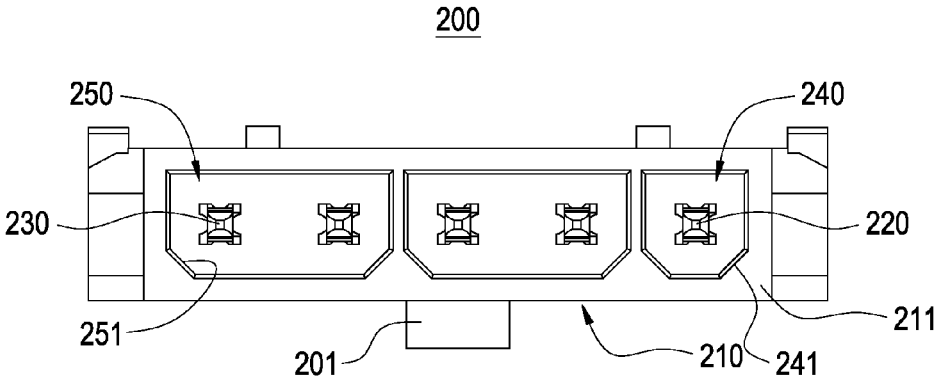
FIG. 10 is a schematic diagram showing the power receptacle of the third embodiment.

Please refer to FIGS. 9 and 10. A power plug 100 and a corresponding power receptacle 200 are provided in the third embodiment of the present disclosure. In the present embodiment, the power plug 100 and the power receptacle 200 are similar to those described in the first embodiment, therefore the descriptions for the same or similar elements are omitted here for brevity.

In the present embodiment, a first pillar 140 and two second pillars 150 are extended from the insulation main body 110 of the power plug 100, a first plug terminal 120 is contained in the first pillar 140, and two second channels 151 are defined on each second pillar 150 to respectively contain two second plug terminals 130. The first plug terminals 120 and the second plug terminals 130 are arranged in a row. The power receptacle 200 has a structure corresponding to the power plug 100. A first slot 240 and two second slots 250 are defined on the insulation base 210, a first receptacle terminal 220 is contained in the first slot 240, and two second receptacle terminals 230 are contained in each second slot 250. The first receptacle terminal 220 and the second receptacle terminals 230 are arranged in a row according to the first plug terminals 120 and the second plug terminals 130.

Figure 11:
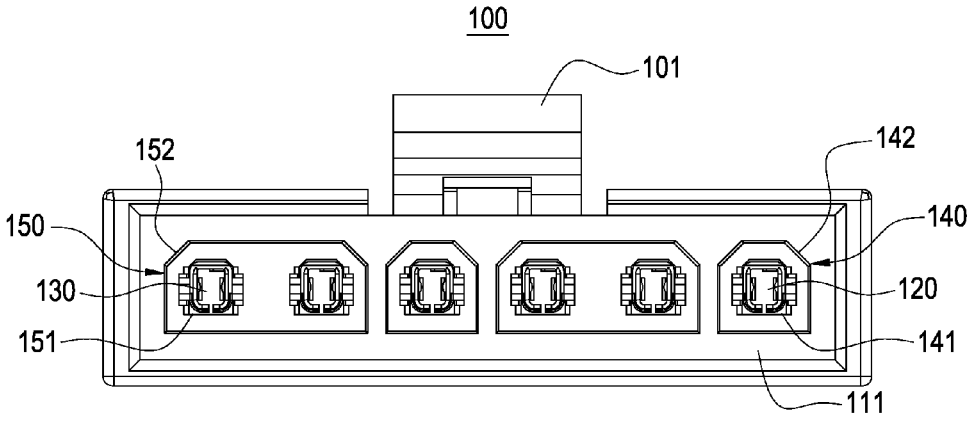
FIG. 11 is a schematic diagram showing the power plug of the fourth embodiment.
Figure 12:
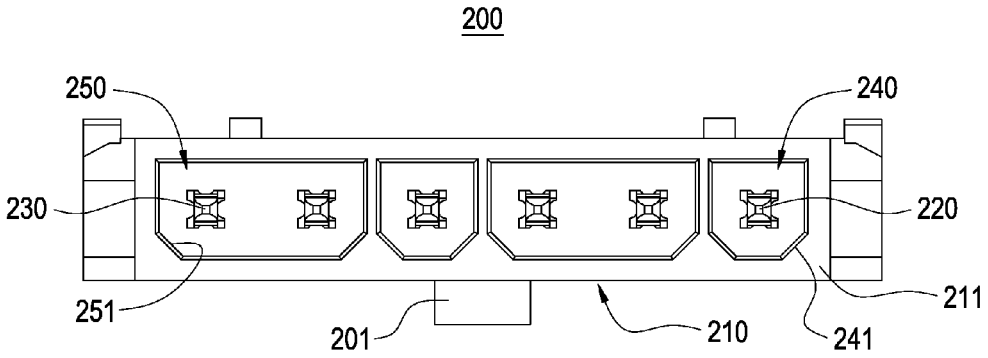
FIG. 12 is a schematic diagram showing the power receptacle of the fourth embodiment.

Please refer to FIGS. 11 and 12. A power plug 100 and a corresponding power receptacle 200 are provided in the fourth embodiment of the present disclosure. In the present embodiment, the power plug 100 and the power receptacle 200 are similar to those described in the first embodiment, therefore the descriptions for the same or similar elements are omitted here for brevity.

In the present embodiment, two first pillars 140 and two second pillars 150 are extended from the insulation main body 110 of the power plug 100, a first plug terminal 120 is contained in each first pillar 140, and two second channels 151 are defined on each second pillar 150 to respectively contain two second plug terminals 130. The first pillars 140 and the second pillars 150 are alternately arranged in a row, and the first plug terminals 120 and the second plug terminals 130 are arranged in a row. The power receptacle 200 has a structure corresponding to the power plug 100. Two first slots 240 and two second slots 250 are defined on the insulation base 210, a first receptacle terminal 220 is contained in each first slot 240, and two second receptacle terminals 230 are contained in each second slot 250. The first receptacle terminal 220 and the second receptacle terminals 230 are arranged in a row according to the first plug terminals 120 and the second plug terminals 130.

Figure 13:
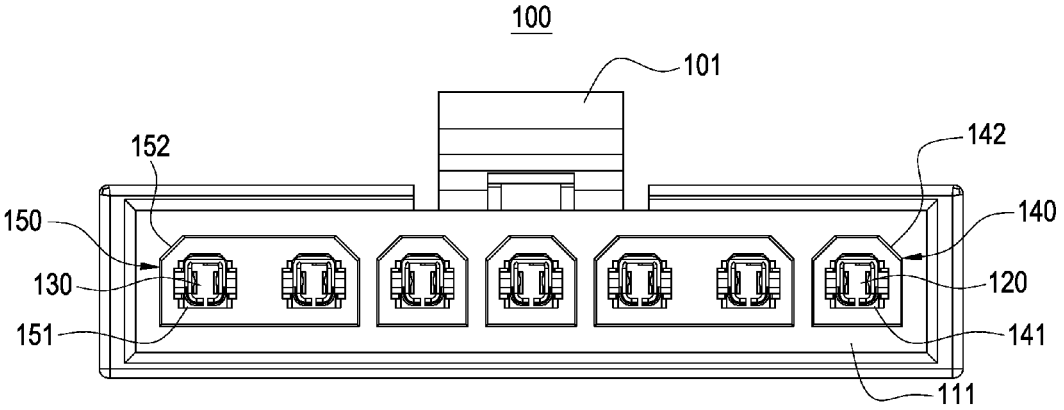
FIG. 13 is a schematic diagram showing the power plug of the fifth embodiment.
Figure 14:
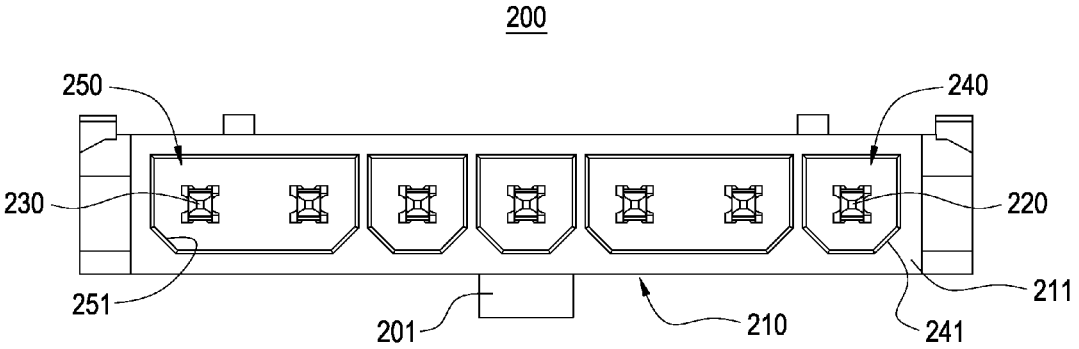
FIG. 14 is a schematic diagram showing the power receptacle of the fifth embodiment.

Please refer to FIGS. 13 and 14. A power plug 100 and a corresponding power receptacle 200 are provided in the fifth embodiment of the present disclosure. In the present embodiment, the power plug 100 and the power receptacle 200 are similar to those described in the first embodiment, therefore the descriptions for the same/similar elements are omitted here for brevity.

In the present embodiment, three first pillars 140 and two second pillars 150 are extended from the insulation main body 110 of the power plug 100, a first plug terminal 120 is contained in each first pillar 140, two first external chamfers 142 are preferably formed at two corners of each first pillar 140, and two second channels 151 are defined on each second pillar 150 to respectively contain two second plug terminals 130. The first pillars 140 and the second pillars 150 are alternately arranged in a row, and the first plug terminals 120 and the second plug terminals 130 are arranged in a row. The power receptacle 200 has a structure corresponding to the power plug 100. Three first slots 240 and two second slots 250 are defined on the insulation base 210, a first receptacle terminal 220 is contained in each first slot 240, and two second receptacle terminals 230 are contained in each second slot 250. The first receptacle terminal 220 and the second receptacle terminals 230 are arranged in a row according to the first plug terminals 120 and the second plug terminals 130. Two first internal chamfers 241 are formed at two corners in each first slot 240, and each first internal chamfer 241 is arranged corresponding to one of the first external chamfers 142.

The power plug 100 and the power receptacle 200 of the present disclosure are limited to couple along a correct direction by an arrangement mixed the first pillar 140 and the second pillar 150. Furthermore, the first external chamfer 142 and the corresponding second internal chamfer 242 are respectively defined on the first pillar 140 and the corresponding first slot 240, and the first pillar 140 is therefore not able to plug into the first slot 240 along an incorrect direction.

Although the present disclosure has been described with reference to the foregoing preferred embodiment, it will be understood that the disclosure is not limited to the details thereof. Various equivalent variations and modifications can still occur to those skilled in this art in view of the teachings of the present disclosure. Thus, all such variations and equivalent modifications are also embraced within the scope of the present disclosure as defined in the appended claims.

What is claimed is:

1. A power plug for coupling with a power receptacle, the power plug comprising:

an insulation main body having a main body front surface, the insulation main body defined a transversal direction on the main body front surface;

a first pillar being protruded from the main body front surface with a first uniform cross-sectional shape, having a first front end surface, a first top surface, a first bottom surface parallel to the first top surface and two first side surfaces opposite to each other, wherein the first pillar has a first channel formed therein along a longitudinal direction of the first pillar, and a first plug terminal arranged in the first channel; and a second pillar being protruded from the main body front surface along the longitudinal direction with a second uniform cross-sectional shape, having a second front end surface, a second top surface, a second bottom surface parallel to the second top surface and two second side surfaces opposite to each other, wherein the second pillar is arranged beside the first pillar along the transversal direction, an interval is formed between the first pillar and the second pillar, wherein the second pillar has a plurality of second channels formed therein along the longitudinal direction, and a plurality of second plug terminals disposed in the second channels respectively, and the first channel and the second channels being arranged in a row along the transversal direction;

wherein a number of the second plug terminals is more than a number of the first plug terminal;

wherein the first front end surface of the first pillar and the second front end surface of the second pillar are coplanar;

wherein the first top surface of the first pillar and the second top surface of the second pillar are coplanar;

wherein the first bottom surface of the first pillar and the second bottom surface of the second pillar are coplanar;

wherein a width of the first pillar between the two first side surfaces is smaller than a width of the second pillar between the two second side surfaces.

2. The power plug according to claim 1, wherein a plurality of main body lateral surfaces surrounding the main body front surface are formed on the insulation main body, and a hook is provided on one of the main body lateral surfaces, wherein the hook is extended above the first top surface of the first pillar and the second top surface of the second pillar.

3. The power plug according to claim 1, wherein a first external chamfer is arranged at a corner of the first pillar.

4. The power plug according to claim 1, wherein a second external chamfer is arranged at a corner of the second pillar.

5. The power plug according to claim 1, wherein the first uniform cross-sectional shape is a rectangular columnar shape; the second uniform cross-sectional shape is a substantial rectangular columnar shape with two external chamfers.

6. A power receptacle for coupling with the power plug according to claim 1, the power receptacle comprising:

an insulation base having a base front surface, a first slot formed therein for receiving the first pillar and a second slot formed therein for receiving the second pillar, wherein the first slot and the second slot are arranged at interval, wherein the first slot and the second slot are arranged along a transversal direction of the base front surface;

wherein the first slot is encircled by a first inner top surface, a first inner bottom surface parallel to the first inner top surface, and two parallel first inner side surfaces; wherein the second slot is encircled by a second inner top surface, a second inner bottom surface parallel to the second inner top surface, and two parallel second inner side surfaces;

wherein the first inner top surface and the second inner top surface are coplanar, wherein the first inner bottom surface and the second inner bottom surface are coplanar;

a first receptacle terminal, disposed in the first slot for coupling with the first plug terminal; and a plurality of second receptacle terminals, disposed in the second slot for coupling with the second plug terminals respectively, the second plug terminals being arranged at interval and parallel with each other, and the first receptacle terminal and the second receptacle terminals being arranged in a row along the transversal direction;

wherein a number of the second receptacle terminal is more than a number of the first receptacle terminals.

7. The power receptacle according to claim 5, wherein a plurality of base lateral surfaces surrounding the base front surface are formed on the insulation base, and a latch is provided on the base lateral surfaces.

8. The power receptacle according to claim 5, wherein each of the first receptacle terminal is extended to protrude a bottom of the corresponding first slot.

9. The power receptacle according to claim 5, wherein each of the second receptacle terminals is extended to protrude a bottom of the corresponding second slot.

10. The receptacle according to claim 5, wherein a first internal chamfer is arranged at a corner of the first slot.

11. A power connector assembly comprising:

a power plug, including:

an insulation main body having a main body front surface, the insulation main body defined a transversal direction on the main body front surface;

a first pillar being protruded from the main body front surface with a first uniform cross-sectional shape, having a first front end surface, a first top surface, a first bottom surface parallel to the first top surface and two first side surfaces opposite to each other, wherein the first pillar has a first channel formed therein along a longitudinal direction of the first pillar, and a first plug terminal arranged in the first channel; and a second pillar being protruded from the main body front surface along the longitudinal direction with a second uniform cross-sectional shape, having a second front end surface, a second top surface, a second bottom surface parallel to the second top surface and two second side surfaces opposite to each other, wherein the second pillar is arranged beside the first pillar along the transversal direction, an interval is formed between the first pillar and the second pillar, wherein the second pillar has a plurality of second channels formed therein along the longitudinal direction, and a plurality of second plug terminals disposed in the second channels respectively, and the first channel and the second channels being arranged in a row along the transversal direction; wherein a number of the second plug terminals is larger than a number of the first plug terminal;

wherein the first front end surface of the first pillar and the second front end surface of the second pillar are coplanar;

wherein the first top surface of the first pillar and the second top surface of the second pillar are coplanar;

wherein the first bottom surface of the first pillar and the second bottom surface of the second pillar are coplanar;

wherein a width of the first pillar between the two first side surfaces is smaller than a width of the second pillar between the two second side surfaces; and a power receptacle, including:

an insulation base having a base front surface, a first slot formed therein for receiving the first pillar and a second slot formed therein for receiving the second pillar, wherein the first slot and the second slot are arranged at interval, wherein the first slot and the second slot are arranged along a transversal direction of the base front surface;

wherein the first slot is encircled by a first inner top surface, a first inner bottom surface parallel to the first inner top surface, and two parallel first inner side surfaces; wherein the second slot is encircled by a second inner top surface, a second inner bottom surface parallel to the second inner top surface, and two parallel second inner side surfaces;

wherein the first inner top surface and the second inner top surface are coplanar, wherein the first inner bottom surface and the second inner bottom surface are coplanar;

a first receptacle terminal, disposed in the first slot for coupling with the first plug terminal; and a plurality of second receptacle terminals, disposed in the second slot for coupling with the second plug terminals respectively, the second plug terminals being arranged at interval and parallel with each other, and the first receptacle terminal and the second receptacle terminals being arranged in a row along the transversal direction;

wherein a number of the second receptacle terminal is larger than a number of the first receptacle terminals.

12. The power connector assembly according to claim 10, wherein a plurality of main body lateral surfaces surrounding the main body front surface are formed on the insulation main body, and a hook is provided on one of the main body lateral surfaces, wherein the hook is extended above the first top surface of the first pillar and the second top surface of the second pillar; wherein a plurality of base lateral surfaces surrounding the base front surface are formed on the insulation base, and a latch is provided on the base lateral surfaces, and the hook snaps the latch.

13. The power connector assembly according to claim 10, wherein a partition wall is formed between the first slot and the second slot.

14. The power connector assembly according to claim 10, wherein two first external chamfers are formed on the second pillar connected the second t top surface and the two second side surfaces respectively, wherein two second internal chamfers are respectively formed at two corners in the second slot connected to the second inner top surface, and the second internal chamfers are fitted with the first external chamfers correspondingly.

15. The power plug according to claim 11, wherein the first uniform cross-sectional shape is a rectangular columnar shape; the second uniform cross-sectional shape is a substantial rectangular columnar shape with two external chamfers.

* * * * *